US009056345B2

(12) United States Patent
Freitag et al.

(10) Patent No.: US 9,056,345 B2
(45) Date of Patent: Jun. 16, 2015

(54) METHOD AND PROFILING INSTALLATION FOR ROLL FORMING A SHEET METAL

(75) Inventors: Stefan Freitag, Sauerlach (DE); Albert Sedlmaier, Holzkirchen (DE); André Abee, Valley (DE)

(73) Assignee: Data M Sheet Metal Solutions GmbH, Oberlaindern (DE)

( * ) Notice: Subject to any disclaimer, the term of this patent is extended or adjusted under 35 U.S.C. 154(b) by 766 days.

(21) Appl. No.: 12/670,327

(22) PCT Filed: Jul. 25, 2008

(86) PCT No.: PCT/EP2008/006167

§ 371 (c)(1),
(2), (4) Date: Jul. 6, 2010

(87) PCT Pub. No.: WO2009/013017

PCT Pub. Date: Jan. 29, 2009

(65) Prior Publication Data

US 2010/0273021 A1 Oct. 28, 2010

(30) Foreign Application Priority Data

Jul. 25, 2007 (DE) ..... 10 2007 034 708

(51) Int. Cl.

| | |
|---|---|
| ***B21C 37/08*** | (2006.01) |
| ***B21D 11/02*** | (2006.01) |
| ***B21D 19/08*** | (2006.01) |
| ***B21D 5/08*** | (2006.01) |

(52) U.S. Cl.

CPC ..... *B21D 5/083* (2013.01); *Y10T 428/1241* (2015.01)

(58) Field of Classification Search

CPC ..... A62B 3/005; B21B 39/14; B21B 39/16; B21C 37/0822; B21C 9/00; B21D 1/10; B21D 1/12; B21D 1/14; B21D 11/02; B21D 11/10; B21D 11/18; B21D 13/04; B21D 13/045; B21D 19/08; B21D 25/00; B21D 25/02; B21D 43/105; B21D 5/00

USPC ..... 72/176, 250, 295, 300, 301, 302, 305, 72/307, 311, 419, 420, 421, 179, 181, 182, 72/293, 296, 297

See application file for complete search history.

(56) References Cited

U.S. PATENT DOCUMENTS

| | | | | |
|---|---|---|---|---|
| 2,288,119 | A * | 6/1942 | Weightman | 72/164 |
| 2,851,080 | A * | 9/1958 | Anderson | 72/161 |
| 2,929,626 | A * | 3/1960 | Weymouth | 226/115 |
| 2,979,806 | A * | 4/1961 | Macomber | 29/897.35 |
| 3,684,145 | A | 8/1972 | Jenkins | |
| 5,142,894 | A * | 9/1992 | Gutowski | 72/129 |

FOREIGN PATENT DOCUMENTS

| | | |
|---|---|---|
| EP | 1640084 A | 3/2006 |

* cited by examiner

*Primary Examiner* — Shelley Self
*Assistant Examiner* — Lawrence Averick
(74) *Attorney, Agent, or Firm* — Lisa V. Mueller; Michael Best & Friedrich LLP

(57) ABSTRACT

A flexible retaining device (1) for a profiling installation for clamping a sheet metal (5) to be profiled is provided. Furthermore, a method for profiling a sheet metal (5) by using the flexible retaining device (1) is provided as well as sheet metal profiled with the method.

16 Claims, 3 Drawing Sheets

METHOD AND PROFILING INSTALLATION FOR ROLL FORMING A SHEET METAL

CROSS-REFERENCE TO RELATED APPLICATIONS

This is the national stage of International Application No. PCT/EP2008/006167, filed on Jul. 25, 2008, which claims the benefit of German Patent Application No. DE 10 2007 034 708.3, filed on Jul. 25, 2007, the contents of all of which are incorporated herein by reference.

The invention refers to a profiling installation for roll forming of cold and hot profiles with variable cross sections comprising at least two roller stands and a flexible retaining device in between for clamping a sheet metal to be profiled, a corresponding method and a product manufactured with this method.

PRIOR ART

During roll forming, rollers cooperating in pairs provide for a profile, the form of which a sheet metal to be formed adopts. In general, forming of the sheet metal takes place in several steps with several roller pairs or roller stands. The step-by-step forming degree of the sheet metal is selected such that the sheet metal is not strained undesirably and deformed.

A device for producing profiled sheet metal with variable cross-sections is known from DE 100 11 755 A1. Therein there is disclosed a concept enabling, in addition to the conventional adjusting possibility transversely to the profiling direction, a rotational movement about the vertical axis. This concept is to eliminate the disadvantages of those functional principles where a tool movement is not possible in which the rollers contact the sheet metal tangentially during the entire profiling process. The adjustment of the rollers not only transversely to the profiling direction is to achieve flawless shaping and to eliminate undesired deformations of the sheet metal.

A similar device for producing profiled sheet metal with variable cross sections is known from DE 10 2004 040 257 A1. The device has an additional roller and a supporting element, where the rollers and supporting elements of the roller stand are intended to ensure that no undesired deformations occur on the sheet metal.

In spite of these provisions to achieve perfect shaping, undesired deformations may occur on the bottom of the sheet metal to be profiled and may lead to deviations from the ideal line of the bottom. The consequence of these undesired deformations is that no continually defined and controlled height of the bottom can be achieved. This leads to deviations from the ideal line of the bottom and to unacceptable product variations.

OBJECT OF THE INVENTION

The object of the present invention is to eliminate the above mentioned drawbacks of the prior art in terms of the undesired deformations during flexible profiling and to provide a formed product with continually defined and controlled height of the bottom.

This object is achieved by a flexible retaining device for a profiling installation for clamping a sheet metal to be profiled during roll forming of cold or hot profiles with variable cross sections and by a corresponding method.

Advantageous further developments of the invention are indicated in the appended claims.

SHORT DESCRIPTION OF THE DRAWINGS

DETAILED DESCRIPTION OF PREFERRED EMBODIMENTS

Figure 1:
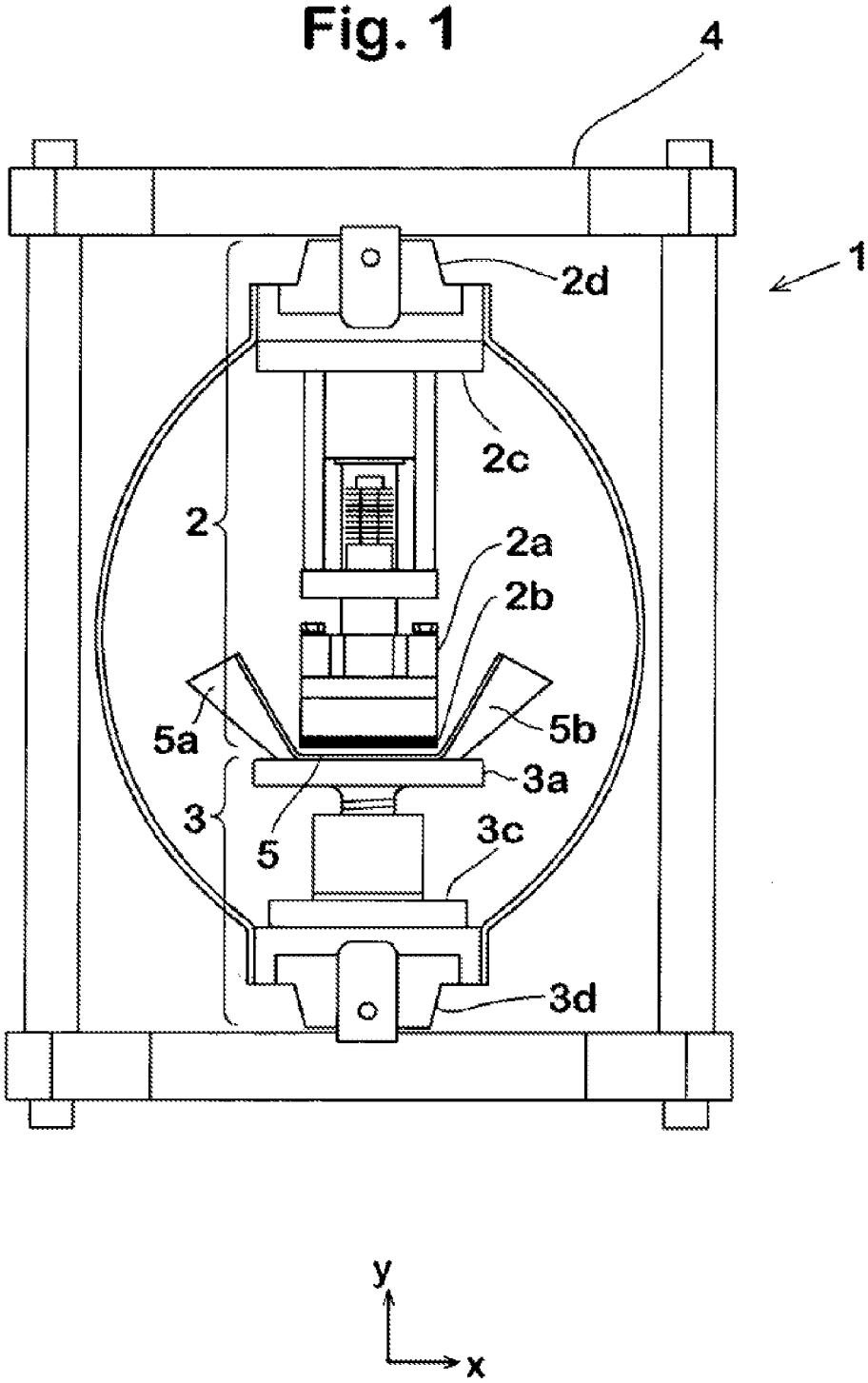
FIG. 1 shows a lateral view of a flexible retaining device according to the present invention.

FIG. 1 shows a flexible retaining device 1 of the present invention for any profiling installation of the prior art. The retaining device 1 includes an upper assembly 2 and a lower assembly 3 clamping a sheet metal 5 to be profiled between them. The two assemblies 2, 3 are arranged movably within a frame 4 by means of an upper guide 2*d* and a lower guide 3*d*.

In one embodiment, the upper assembly 2 includes a holding fixture 2*c* and a displaceable upper clamping jaw 2*a* with an adjustable clamping pad 2*b*. The lower assembly 3 includes a holding fixture 3*c* and a displaceable lower clamping jaw 3*a*. The guides 2*d*, 3*d* can be embodied as rail guides. In another embodiment, the guides 2*d*, 3*d* can be embodied as roller guides. In a further embodiment, the guides 2*d*, 3*d* can be embodied as dovetail guides, prismatic guides, narrow guides or cylindrical guides. The shape of the upper guide 2*d* can differ from that of the lower guide 3*d*. Although not shown, a lower clamping pad, analogously to the upper clamping pad, can be provided which can be adapted in function like the upper clamping pad.

Advantageously, the displaceable upper clamping jaw 2*a* can be pressed onto the sheet metal 5 to be profiled and against the lower clamping jaw 3*a* by a hydraulic leverage in a direction perpendicular to the sheet metal feeding direction. In another embodiment, only the clamping jaw 2*a* is pressed against the sheet metal by a pneumatic or electromagnetic leverage, the lower clamping jaw 3*a* being adjustable to a predefined height by a screw.

In one embodiment, the assemblies 2, 3 of the flexible retaining device 1 clamp the sheet metal on both sides from above and below. In another embodiment, the assemblies 2, 3 clamp the sheet metal embracingly on one or both sides 5*a*, 5*b*.

In one embodiment, the assemblies 2, 3 of the flexible retaining device 1 are drawn along passively, i. e. with no separate drive via motors, with the sheet metal feed on the guides 2*d*, 3*d* within the frame 4. In this manner, no additional forces are introduced into the sheet metal during the profiling process so that 100% correspondence with the sheet metal feed is ensured. In another embodiment, the assemblies 2, 3 in the frame 4 are driven actively, i. e. with a separate drive via motors, on the guides 2*d*, 3*d* in the frame 4 in the direction of the sheet metal feed. However, in case of this active transport of the assemblies 2, 3, synchronization with the sheet metal feed is necessary. Also, combinations of active driving and passive drawing are considered by the invention.

Figure 2:
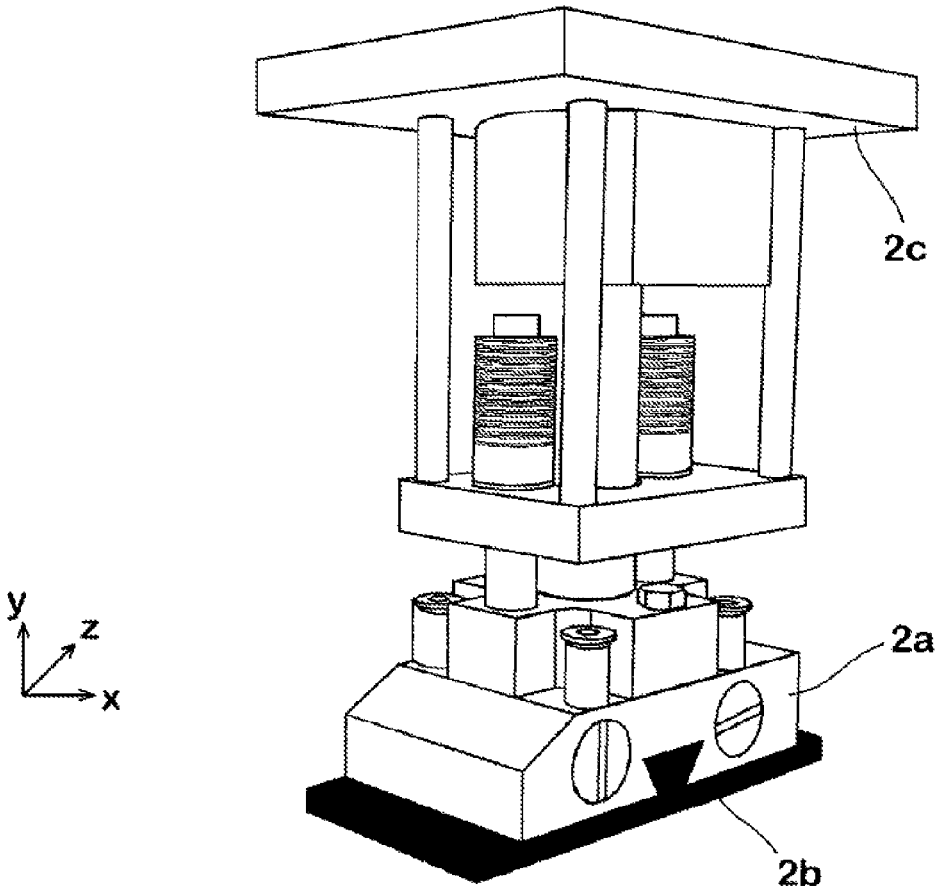
FIG. 2 shows a perspective view of an upper assembly of the flexible retaining device of FIG. 1 with a displaceable upper clamping jaw 2*a* with an adjustable clamping pad 2*b* of the present invention.

FIG. 2 shows an upper assembly 2 with a displaceable upper clamping jaw 2*a* having an adjustable clamping pad 2*b* of the present invention.

According to the invention, means are used for adjusting the clamping pad 2*b* during the profiling process in the feed plane (plane xz) or perpendicular to the feed plane (y direction). These means adapt the clamping pad 2*b* to the profile of the sheet metal in width, height, shape or position since in case of three-dimensional cross sections, i. e. with a bottom variable in height, the assembly 2 must follow the bottom of the profile and be adjusted in height and inclination. If the sheet metal is bent on different sides with respect to the bottom, it would be conceivable for these means to work on the respective sides of the bottom. By this adjustment, a collision with the sides 5*a*, 5*b* is avoided and the sheet metal is not subjected to undesired deformations.

Figure 3:
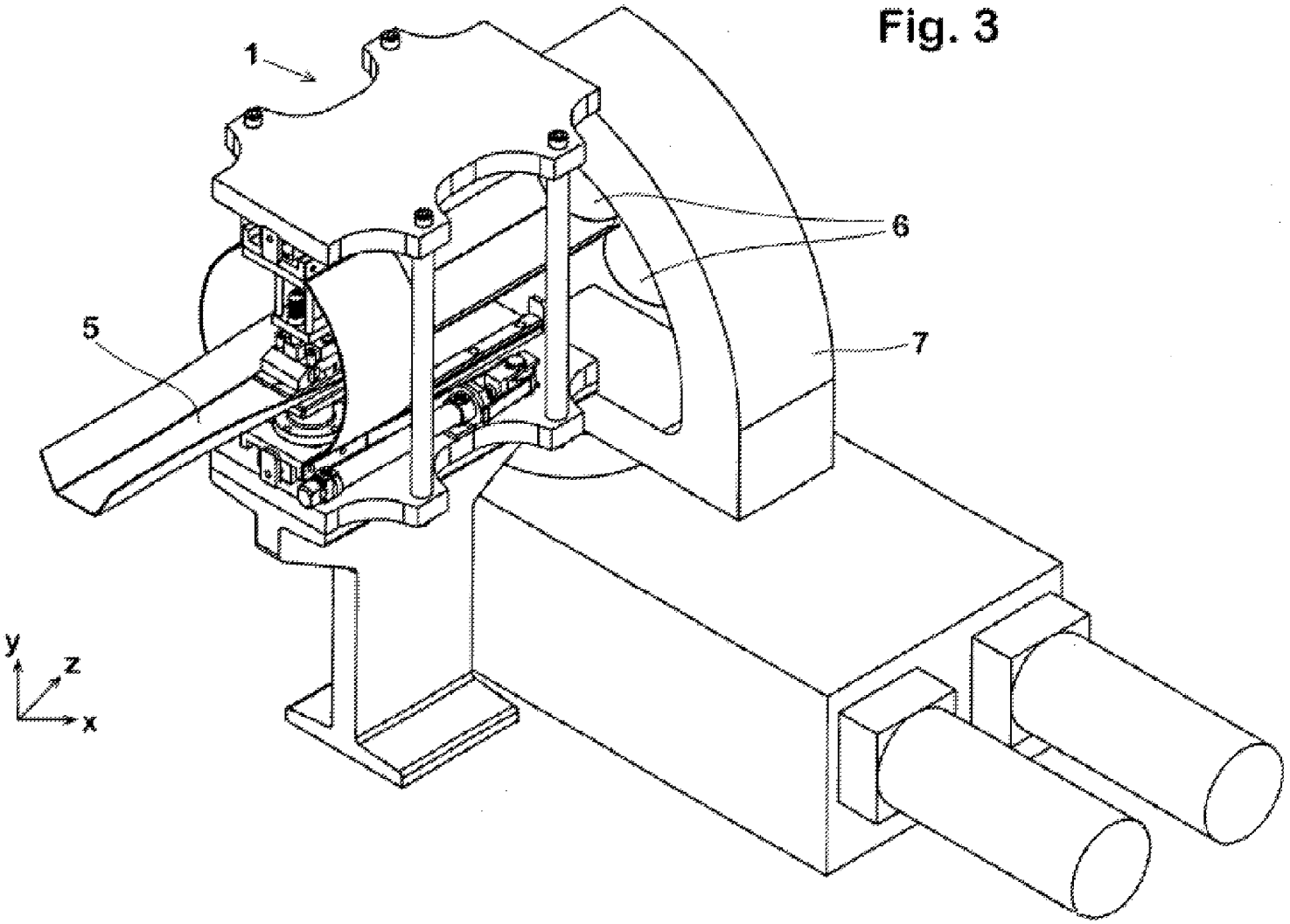
FIG. 3 shows a perspective view of a flexible retaining device according to the present invention which is integrated in a profiling installation of the prior art.

FIG. 3 shows a flexible retaining device 1 according to the present invention which is integrated in a profiling installation according to the prior art. A method for profiling a sheet metal 5 by using the flexible retaining device 1 includes the steps described in the following. Only one roller stand is shown in FIG. 3, but for the person skilled in the art, it is readily understandable that upstream and downstream of the roller stand, there are other roller stands which are part of a profiling installation.

In step 1, the sheet metal 5 to be profiled is clamped. For this purpose, the two assemblies 2, 3 press the profile of the sheet metal at a defined portion starting from an initial position (resting position). This predefined portion is determined in advance depending on the type of deformation and the sheet metal material used and also on the geometry of the roller device. The sheet metal is clamped on both sides from above and below. Alternatively, the sheet metal can be clamped embracingly on one or both sides 5*a*, 5*b*. During clamping of the sheet metal, it must be ensured that the pressing force is larger than the deformation force of the place to be clamped. Furthermore, all degrees of freedom, excepting the degree of freedom of the profiling direction, must be blocked so that no relative movement between the sheet metal and the retaining device is possible. Thus, undesired deformations of the sheet metal can be excluded and a continually defined and controlled height of the bottom can be achieved.

In step 2, the clamped sheet metal 5 is guided, during profiling, in the profiling direction with linear transport of the assemblies 2, 3. Thus, the assemblies 2, 3 move as one unit together with the sheet metal 5 to be profiled. The assemblies 2, 3 can be passively drawn along with the sheet metal feed. Introduction of additional forces into the sheet metal is avoided, and 100% correspondence with the sheet metal feed is ensured. Alternatively, the assemblies 2, 3 can be actively driven by motors in the direction of the sheet metal feed. In this case of transport of the assemblies 2, 3, however, a synchronization with the sheet metal feed is required. In this manner as well, undesired deformations of the sheet metal can be excluded and a continually defined and controlled height of the bottom can be achieved.

In this step 2, it is further preferred that the assemblies 2, 3 with the sheet metal clamped be brought as close as possible to the forming rollers 6 so as to have a guiding distance of the sheet metal as long as possible and a contact time with the sheet metal as long as possible.

Also, it is further preferred in this step 2 with three-dimensional cross sections, i.e. with height-variable bottoms, that the clamping pad 2*b* can be adjusted in width, height, shape or position to the profile of the sheet metal 5 during profiling. In this manner, a collision with the sides 5*a*, 5*b* is avoided. The assembly 2 can follow the bottom of the profile and adjust in height and inclination. In this manner as well, undesired deformations of the sheet metal can be excluded and a continually defined and controlled height of the bottom can be achieved.

In step 3, the clamping of the guided assemblies 2, 3 is released when the clamped portion reaches the next roller stand 7.

In step 4, the assemblies 2, 3 are returned to the initial position (resting position). After that, the steps 1-4 can be carried out again.

With the above described retaining device 1 of the present invention which can be integrated in a profiling installation according to the prior art, and with the method of the invention, sheet metal can be profiled which does not have the above mentioned disadvantages of the prior art. These sheet metal, having uniform quality due to a continually defined and controlled height of the bottom, can be manufactured, for instance, in the automotive industry, with the possibilities of application not being limited to this area.

If technical features mentioned in any of the claims are marked by a reference number, these reference numbers have been merely included to increase comprehensibility of the claims. Accordingly, these reference numbers have no limiting effect on the scope of each element identified by way of example by such reference numbers.

LIST OF REFERENCE NUMBERS

1 flexible retaining device
2 upper assembly
2*a* displaceable upper clamping jaw
2*b* adjustable clamping pad
2*c* holding fixture
2*d* upper guide
3 lower assembly
3*a* displaceable lower clamping jaw
3*c* holding fixture
3*d* lower guide
4 frame
5 sheet metal to be profiled
5*a* side
5*b* side
6 forming rollers
7 roller stand

The invention claimed is:

1. A profiling installation for roll forming a sheet metal, the profiling installation comprising:

at least two roller stands; and a retaining device for clamping the sheet metal, the retaining device being disposed between said at least two roller stands, the retaining device comprising:

a frame;

an upper guide movably arranged on the frame;

a lower guide movably arranged on the frame;

an upper assembly including an upper holding fixture coupled to the upper guide and a displaceable upper clamping jaw coupled to the upper holding fixture, the upper clamping jaw having an adjustable clamping pad; and a lower assembly including a lower holding fixture coupled to the lower guide and a displaceable lower clamping jaw coupled to the lower holding fixture, wherein the upper assembly and the lower assembly are movably arranged within the frame, the upper assembly and the lower assembly configured to clamp the sheet metal therebetween so that relative movement between the sheet metal, the upper assembly, and the lower assembly is prevented, the upper assembly and the lower assembly being movable in a degree of freedom along a profiling direction, wherein the displaceable upper clamping jaw is pressed onto the sheet metal to be profiled and against the lower clamping jaw by hydraulic, pneumatic or electromagnetic leverage, wherein the upper assembly and the lower assembly move synchronously with the sheet metal feed for blocking all degrees of freedom excepting the degree of freedom of the profiling direction.

2. The profiling installation according to claim 1, wherein each of the upper and the lower guides comprise a rail guide, a roller guide, a dovetail guide, a prismatic guide, a narrow guide or a cylindrical guide.

3. The profiling installation according to claim 1, wherein the upper assembly and the lower assembly clamp the sheet metal on both sides from above and below.

4. The profiling installation according to claim 1, wherein the upper assembly and the lower assembly clamp the sheet metal embracingly on one or both sides.

5. The profiling installation according to claim 1, the upper assembly and the lower assembly move passively with the sheet metal feed.

6. The profiling installation according to claim 1, wherein the upper assembly and the lower assembly are actively driven in the direction of the sheet metal feed.

7. The profiling installation according to claim 1, wherein the clamping pad is adjustable in width, height, shape or position according to the profile of the sheet metal.

8. A method for profiling a sheet metal by using a profiling installation for roll forming the sheet metal comprising at least two roller stands and a retaining device disposed between said at least two roller stands and configured for clamping the sheet metal, the retaining device comprising an upper assembly and a lower assembly arranged within a frame, the upper assembly and the lower assembly configured to clamp the sheet metal in a defined portion and movable in a degree of freedom, wherein the upper assembly movable in the frame by an upper guide and the lower assembly movable in the frame by a lower guide such the upper assembly and the lower assembly move synchronously with the sheet metal feed in a feeding direction for blocking all degrees of freedom excepting the degree of freedom of the profiling direction, the method comprising:

clamping the sheet metal between the upper assembly and the lower assembly;

pressing the sheet metal in the defined portion at an initial position, a pressing force being greater than a deformation force of the defined portion and all degrees of freedom except the degree of freedom of the profiling direction being blocked so that a relative movement between the sheet metal and the upper and the lower clamping assembly is prevented;

guiding the sheet metal with linear transport of the upper assembly and the lower assembly in the profiling direction so that the upper assembly and the lower assembly move as a unit with the sheet metal;

releasing clamping of the upper assembly and the lower assembly when the defined portion reaches a next roller stand of the at least two roller stands; and returning the upper assembly and the lower assembly to the initial position.

9. The method according to claim 8, where guiding the sheet metal include bringing the upper assembly and the lower assembly as close as possible to the two forming rollers.

10. The method according to claim 8, where clamping the sheet metal includes clamping the sheet metal on both sides from above and below.

11. The method according to claim 8, where clamping the sheet metal includes clamping the sheet metal embracingly on one or both sides.

12. The method according to claim 8, where guiding sheet metal includes transporting the upper assembly and the lower assembly passively.

13. The method according to claim 8, where guiding sheet metal includes actively driving the upper assembly and the lower assembly in the direction of the sheet metal feed.

14. The method according to claim 8, further comprising adjusting the clamping pad to the profile of the sheet metal in width, height, shape or position.

15. The profiling installation according to claim 1, wherein the upper assembly and the lower assembly move as a unit with the sheet metal.

16. The profiling installation according to claim 1, wherein the upper assembly and the lower assembly are linearly transported with the sheet metal relative to the frame in the profiling direction.

* * * * *